US011725918B2

(12) United States Patent
Thuman

(10) Patent No.: US 11,725,918 B2
(45) Date of Patent: Aug. 15, 2023

(54) DEVICE AND METHOD FOR OBTAINING A HORIZONTAL DISPERSION PATTERN

(71) Applicant: BAE SYSTEMS BOFORS AB, Karlskoga (SE)

(72) Inventor: Christer Thuman, Karlskoga (SE)

(73) Assignee: BAE SYSTEMS BOFORS AB, Karlskoga (SE)

( * ) Notice: Subject to any disclaimer, the term of this patent is extended or adjusted under 35 U.S.C. 154(b) by 179 days.

(21) Appl. No.: 16/759,762

(22) PCT Filed: Sep. 26, 2018

(86) PCT No.: PCT/SE2018/050977
§ 371 (c)(1),
(2) Date: Apr. 28, 2020

(87) PCT Pub. No.: WO2019/108105
PCT Pub. Date: Jun. 6, 2019

(65) Prior Publication Data

US 2021/0180929 A1 Jun. 17, 2021

(30) Foreign Application Priority Data

Nov. 28, 2017 (SE) ..... 1700292-4

(51) Int. Cl.
*F42B 12/60* (2006.01)
*F42B 10/26* (2006.01)

(52) U.S. Cl.
CPC ..... *F42B 12/60* (2013.01); *F42B 10/26* (2013.01)

(58) Field of Classification Search
CPC ..... F42B 10/26; F42B 12/32; F42B 12/58; F42B 12/60; F42B 14/02
(Continued)

(56) References Cited

U.S. PATENT DOCUMENTS 2,264,906 A 12/1941 Roby
2,379,203 A * 6/1945 Vertzinsky ..... F42B 12/60 102/504

(Continued)

FOREIGN PATENT DOCUMENTS

EP 0 395 520 A1 * 10/1990 ..... F42B 12/60
GB 1588114 A 4/1981
WO 03100345 A1 12/2003

OTHER PUBLICATIONS

International Search Report (dated Jan. 15, 2019) for corresponding International App. PCT/SE2018/050977.

(Continued)

*Primary Examiner* — James S Bergin
(74) *Attorney, Agent, or Firm* — WRB-IP PLLC

(57) ABSTRACT

A payload container for providing a horizontal dispersion pattern of sub-projectiles suitable for combatting surface targets is in the form of a cylinder and includes at least two sub-projectiles arranged in a core enclosed by a container wall, wherein the sub-projectiles are linearly disposed. In addition, a projectile and use of the same include at least one payload container or a plurality of sequentially arranged payload containers displaced by a displacement angle relative to each other. The displacement angle is predetermined in such way so that the sub-projectiles are vertically lined at the time when the mechanical force from the carrier shell disappears and the sub-projectiles are spread to the left and to the right, providing a horizontal dispersion pattern.

8 Claims, 7 Drawing Sheets

(58) Field of Classification Search
USPC ..... 102/393, 489
See application file for complete search history.

(56) References Cited

U.S. PATENT DOCUMENTS 2,925,985 A 2/1960 Pierce
3,093,072 A * 6/1963 Pigman ..... F42B 12/60 102/393
3,276,367 A * 10/1966 Edwards ..... F42B 10/58 102/393
4,002,121 A 1/1977 Prochnow et al.
4,072,107 A * 2/1978 Saxe ..... F42B 12/58 102/388
4,488,489 A * 12/1984 Schoffl ..... F42B 12/58 102/350
4,676,167 A 6/1987 Huber et al.
4,750,423 A 6/1988 Nagabhushan
4,793,260 A * 12/1988 Kruse ..... F42B 12/62 102/357
4,974,515 A 12/1990 Busch et al.
5,817,969 A 10/1998 Ettmueller
5,864,086 A * 1/1999 Ettmuller ..... F42B 12/58 102/357
6,279,482 B1 8/2001 Smith et al.
6,505,561 B1 * 1/2003 Dietrich ..... F42B 12/62 102/357
7,040,235 B1 * 5/2006 Lloyd ..... F42B 12/64 102/497
7,261,039 B1 * 8/2007 Bittle ..... F42B 12/64 89/1.14
7,624,683 B2 * 12/2009 Lloyd ..... F42B 12/64 102/497
7,845,283 B2 * 12/2010 Finneral ..... F41H 13/00 102/386
9,423,226 B2 * 8/2016 Cillaut ..... F42B 12/64
11,236,980 B2 * 2/2022 Thuman ..... F42B 12/62

OTHER PUBLICATIONS

Swedish Official Action (dated May 31, 2018) for corresponding Swedish Application 1700292-4.

* cited by examiner

Fig. 1a
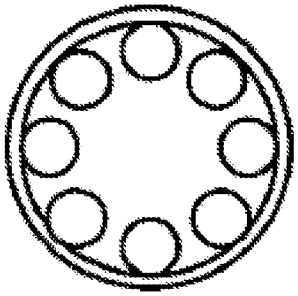
Fig. 1b
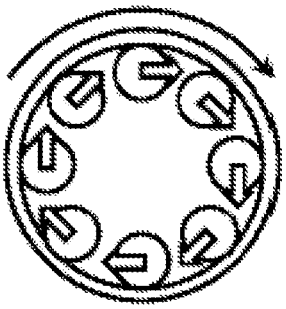
Fig. 1c
Fig. 2a
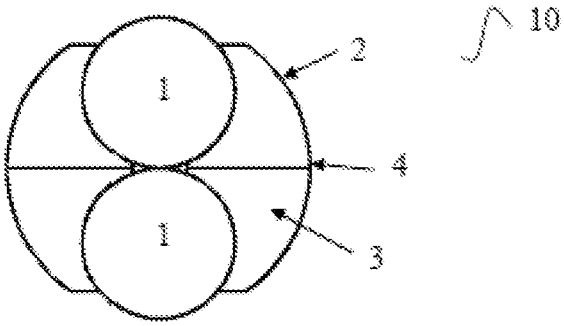

DEVICE AND METHOD FOR OBTAINING A HORIZONTAL DISPERSION PATTERN

BACKGROUND AND SUMMARY

The present invention relates to the field of spin stabilized projectiles comprising a releasable payload and dispersion patterns, more particularly to horizontal dispersion patterns suitable for combatting surface targets.

Direct fire refers to the launching of a projectile directly at a target within the line-of-sight of the firer. Projectiles used in direct fire usually transport various payloads for various purposes and various uses, such as surface to surface, surface to air, and air to air. The Phalanx CIWS (Raytheon) is a close-in weapon system for defence against anti-ship missiles. The system comprise optimized gun barrels (OGB), and Enhanced Lethality Cartridges (ELC) for additional capabilities against asymmetric threats such as small manoeuvring surface craft, slow-flying fixed and rotary-winged aircraft, and unmanned aerial vehicles thus providing tighter dispersion and increased "first-hit" range. The rounds are armour-piercing tungsten penetrator rounds or depleted uranium with discarding sabots.

U.S. Pat. No. 4,002,121 discloses a ballistic projectile comprising an incendiary-type payload for a heavy duty ballistic projectile. The payload is comprised in a plurality of payload containers successively disposed between the nose and tail sections of the projectile and the payload containers are ejected from the tail in a scattered ring-like area of the targeted terrain and remain intact upon impact with the target terrain.

U.S. Pat. No. 5,817,969 discloses a spin-stabilized projectile containing a payload chamber comprising sub-projectiles that are released via the chamber wall when the payload chamber opens along a casing line from the bottom to the top (cap). The dispersion pattern is circular, which is suitable for air targets but less suitable for surface targets. The construction of the carrier shell is complex and the aim is to fill the casing with maximum number of sub-projectiles for improved hit rate, i.e., quantity. The drawbacks by prior art is that the high number of sub-projectiles makes the projectile heavy, and the circular dispersion pattern provides a quite low hit rate close to ground or water when sub-projectiles going upward into the air or downward hitting the ground early are wasted and may increase the risk for collateral damage.

In view of the background art there is a need of developing improved devices and methods that enable a horizontal dispersion pattern, thereby providing increased hit rate and efficiency, and decreased risk for unintended damage to the surroundings.

It is desirable to provide a device for providing a horizontal dispersion pattern i.e., a payload container.

The payload container according to an aspect of the present invention is in the form of a cylinder. The container comprises at least two sub-projectiles arranged in a core. The core can be of any suitable material. The core and the sub-projectiles are enclosed by a container wall. The container wall may be a part of the core, i.e., the sub-projectiles are embedded in and enclosed by the core material.

The at least two sub-projectiles are arranged in a line. The sub-projectiles are linearly disposed along a cord. The sub-projectiles can be arranged in more than one line. The sub-projectiles may also be disposed in at least two parallel lines or cords. The sub-projectiles can be arranged in more than one line, along a cord.

The sub-projectiles may be disposed in at least two layers. The layers are substantially arranged in one plane.

The orientation of the sub-projectiles is vertical when the sub-projectiles are released from the payload container against a target.

The number of sub-projectiles arranged in one payload container depends on the type and aim of the projectile. The number may be in the range of 2-1000 sub-projectiles.

In one aspect the sub-projectiles may be any of flechettes, rods, balls, spheres, discs, cubes or hexagons. In another aspect the sub-projectiles may be a combination of different kinds of payload, sub-projectiles.

In yet another aspect the sub-projectiles may be made of hard metal or heavy metal.

In one embodiment, the at least one payload container is arranged to at least one more payload container, forming a stack of containers. The first payload container (A) is displaced in relation to the second payload container (B). The displacement $\varphi$ of the containers results in that the direction of sub-projectiles in the first container (A) is not the same as the direction of the sub-projectiles in the second container (B). The displacement angle $\varphi$ results in that the sub-projectiles in respective payload container is in a vertical direction when the mechanical force from the projectile wall disappears, resulting in a horizontal dispersion pattern. The angle $\varphi$ between the payload containers is predetermined.

The number of payload containers in a stack depends on the aim of the projectile. In one embodiment the number of payload containers is in the range of 2 to 1000. Each payload container is in one embodiment displaced $\varphi$ in the range of 0-180 degrees to the next payload container.

It is also desirable to provide a spin stabilized projectile for providing a horizontal dispersion pattern. The projectile according to an aspect of the invention comprises at least one payload container comprising at least two sub-projectiles arranged in at least one line as described above. The payload container may comprise a plurality of layers of sub-projectiles wherein the layers are arranged in substantially on plane. The payload containers are arranged and displaced in relation to each other as described above.

A suitable spin stabilized projectile comprises an elongated casing having a longitudinal axis extending from a nose portion of said elongated body to a rear portion of said elongated body, the nose part is arranged to a front portion and comprises a fuze for activating the primer device and a sensor. The sensor may in one embodiment be a gyro. A payload chamber is disposed in the front portion and comprises at least one payload container having at least two sub-projectiles arranged substantially in one plane as described above.

In one embodiment the payload chamber of the projectile comprises at least one payload container as described above.

In one embodiment the payload chamber comprises a plurality of sequentially arranged payload containers. The number of payload containers may be in the range of 2-1000.

The containers are displaced in relation to each other. The displacement angle, $\varphi$, may be in the range of 0-180 degrees.

It is also desirable to use the projectile described above, comprising at least one of the above described payload chambers for providing a horizontal dispersion pattern.

BRIEF DESCRIPTION OF DRAWINGS

The invention is now described, by way of examples, with reference to the accompanying drawings, in which:

FIGS. 1*a-c*: Show a cross section of a projectile comprising sub-projectiles of prior art (a), the velocity tangent of each sub-projectile upon separation from a projectile (b) and an illustration of a circular dispersion pattern (c).

FIGS. 2*a-e*: Show cross sections of different embodiments of sub-projectiles arranged in a payload container (a, c); the velocity tangent of each sub-projectile upon separation from a projectile (b, d) of the embodiments shown in a) and c), and an illustration of the displacement angle φ is shown in e.

DETAILED DESCRIPTION

Before the invention is disclosed and described in detail, it is to be understood that this invention is not limited to particular materials or configurations disclosed herein as such configurations and materials may vary. It is also to be understood that the terminology employed herein is used for the purpose of describing particular embodiments only and is not intended to be limiting since the scope of the present invention is limited only by the appended claims.

In the context of the present invention the term dispersion pattern means the distribution of rounds fired from a weapon.

In context of the present invention the term sub projectile means a small weapon or device that is part of a larger warhead and separates from it prior to impact, e.g., rods, flechettes, arrow-like darts, cylindrical, rectangular, hexagonal, cuboid, disc, spherical or ball-shaped i.e., not only munitions of various kinds, but all kinds of payloads, from which a specific continued flight on a determined flight path is expected after its release.

In context of the present invention the term payload container defines a device that encloses an assembly of sub-projectiles, at least two sub-projectiles.

Figure 7A:
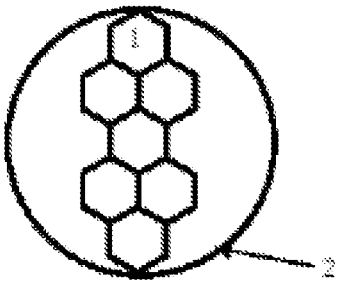
FIGS. 7*a-c* Show a payload container comprising sub-projectiles with a hexagonal cross section, with small sub-projectiles in a first layer (a), and larger sub-projectiles in a second layer (b), and first and second layer with offset angle (c).
Figure 7B:
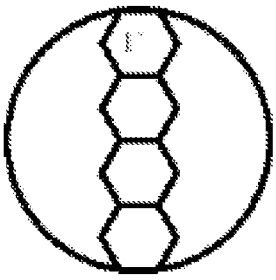
Figure 7C:
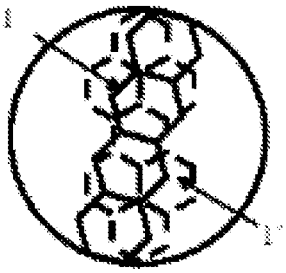

In context of the present invention the term substantially one plane means that sub-projectiles arranged in at least two layers in the same payload container may be somewhat displaced in relation to each other see for example FIG. 7*a-c* for illustration.

In context of the present invention the term stack defines a plurality of payload containers arranged after each other.

The term displaced means that the first line of sub-projectiles in the first payload container is rotated a certain angle, φ, in respect of the second line of sub-projectiles in the second payload container.

The term chord of a circle is a straight line segment whose endpoints both lie on the circle. Among properties of chords of a circle are the following: Chords are equidistant from the centre if and only if their lengths are equal; Equal chords are subtended by equal angles from the centre of the circle; A chord that passes through the centre of a circle is called a diameter, and is the longest chord. Every diameter is a chord, but not every chord is a diameter. In this application chords are used to illustrate that the projectiles are not radially disposed.

The present invention will now be described in detail with reference to the accompanying figures, in which embodiments of the invention are shown.

The present invention provides an arrangement of payload containers comprising sub-projectiles for providing an elongated dispersion pattern, i.e., a horizontal dispersion pattern. A horizontal dispersion pattern is suitable for combatting surface targets; targets having little vertical extent located on for example the water surface, Fast Inshore Attack Craft (water vehicle; various locations, FIAC), shore targets, ground targets, i.e., land or sea targets moving in two dimensions in general.

FIGS. 1*a* and *b* show cross-sections of a projectile 50 comprising sub-projectiles 1 of prior art. The sub-projectiles 1 are evenly distributed in a circular pattern in the projectile (a). When the projectile is fired it is travelling forward in the flight direction and rotates around its longitudinal axis. At a predetermined time the separation charge is initiated and the sub-projectiles are released from the shell. The sub-projectiles departs in the tangential direction from the carrier shell (b) resulting in a circular dispersion pattern (c).

FIG. 2*a* shows a two dimensional cross sections of a payload container 10 comprising two sub-projectiles 1 arranged substantially linear to each other in a payload container 10. The sub-projectiles are arranged, embedded, enclosed or fixed at least partially by a core material 3. The core 3 disposes the sub-projectiles 1 in position in the payload container, enclosed by the container wall 2. The container wall may be a part of the core material 3. The core 3 material may be one of those known by the art. The core 3 may also be designed as a holding device (not shown) enclosing each of the sub-projectiles 1 in a payload container. The holding device may function as a payload chamber. The design of a holding device may vary. In one embodiment the support device is designed as a core with at least two legs protruding from the core 3. Each leg encloses at least partly one sub-projectile 1 each. The number of legs depends on the number and type of sub-projectiles, projectile, aim and target, etc. The supporting device may also have the effect of decreasing disturbances i.e., tumbling, when sub-projectiles separate from a projectile e.g., a cylinder or carrier shell. By decreasing the number of contact-impact events the effect and/or penetration of the sub-projectiles into a target is improved. A supporting device may also be used in combination with any core material 3. The payload container may be dividable along line 4. The invention is not limited to a two-part construction. The construction can be dividable in two or several parts or not dividable at all.

In one embodiment, the centre of the core 3 may comprise a bore for arrangement of a continuous detonator wire, for example a shock tube or an electric wire.

Figure 2B:
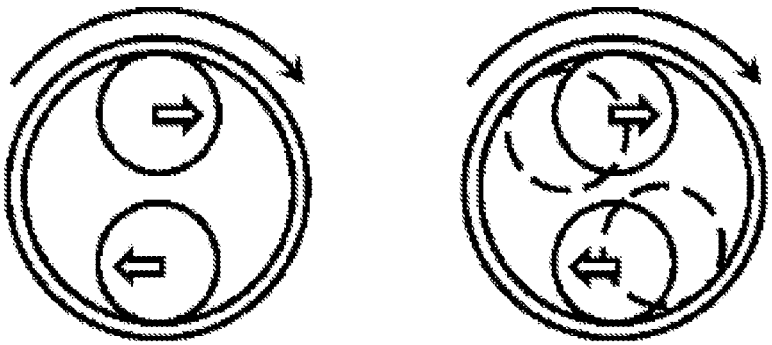

FIG. 2*b* illustrates on the left hand the velocity tangent (straight arrows) of the sub-projectiles in (a) during rotation (curved arrow) of the projectile, and on the right hand the sub-projectiles 1 in a first payload container in relation to the sub-projectiles 1 in a second payload container (dashed circle).

Figure 2C:
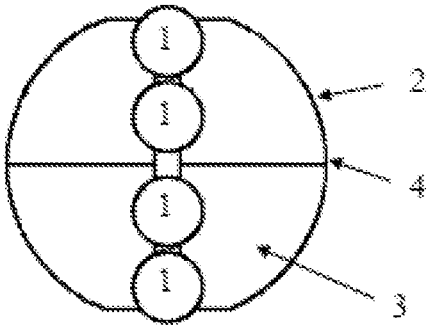

FIG. 2*c* shows a payload container 10 comprising four sub-projectiles 1 arranged in line, the payload container 10 comprises a container wall 2, a core 3, and a line 4. Line 4 may be a dividing line. This embodiment of the payload container comprises two sub-projectiles 1 described above.

In another embodiment the centre of the core 3 may comprise a bore for arrangement of a continuous detonator wire, for example a shock tube or an electric wire.

Figure 2D:
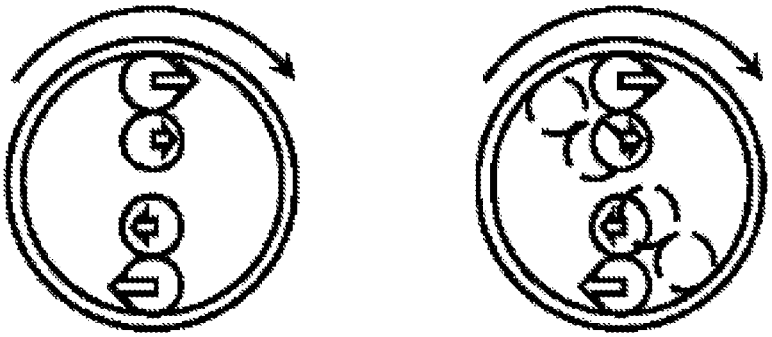

FIG. 2*d* illustrates on the left hand the velocity tangent (straight arrows) of the sub-projectiles 1 during rotation (curved arrow) of the projectile, and on the right hand the sub-projectiles 1 in a first payload container in relation to the sub-projectiles 1 in a second payload container (dashed circle).

Figure 2E:
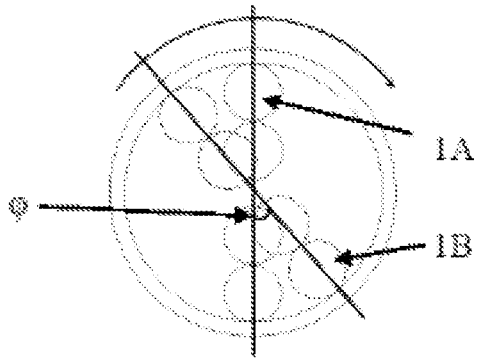

The number of sub-projectiles 1 is not limited to the examples shown here. The number of sub-projectiles 1 in one payload chamber 10 can be in the range of 2-1000 depending on the size of the sub-projectiles 1, the aim, target and/or the payload container 10 and the projectile 50. In other embodiments the number of sub-projectiles 1 may be in the range of 2-500, or 2-100, or 2-75, or 2-50, and in other embodiments in the range of 2-25. FIG. 2*e* shows the displacement angle φ between the first payload container A comprising sub-projectiles arranged in a line 1A (solid line), in relation to the next payload container B comprising sub-projectiles arranged in line 1B (dotted line). The angle of displacement φ of the payload containers 10 in relation to each other depends on the spin velocity and the longitudinal velocity relative to the carrier shell 50 from which the payload containers are ejected. A separation charge may give the payload containers 10 slightly different exit velocities, and therefore the displacement angle of each payload container may have to be different.

Generally, the displacement angle φ is the angle in degrees that the projectile rotates during the time t (s). φ (°) corresponds to the displacement angle that the payload container 10 is displaced for providing a horizontal dispersion patent. φ is calculated by the formula:

$$\varphi = \omega_{projectile} \cdot \frac{L_{payload\ container}}{v_{separation}} \cdot \frac{180°}{\pi}$$

wherein

ω is the angular velocity (rad/s) of the projectile 50;

v is the velocity (m/s) of the payload container 10 in relation to the projectile 50;

L is the length (m) of the payload chamber 80;

t is the time (s) it takes for the payload container 10 to leave the projectile 50.

The displacement angle φ (°) can thus vary between the containers 10 in a stack 100, the condition is that the line of sub-projectiles 1 are in a vertical position when leaving the projectile 50 and payload container 10 resulting in the horizontal dispersion pattern.

Figure 3A:
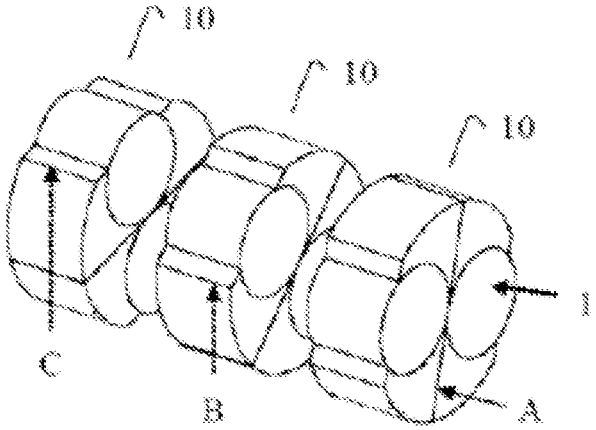
FIGS. 3*a-d* Show perspective views of three payload containers in a line (a, b), the embodiment of (b) arranged in a stack of six payload containers displaced in relation to each other (c), and a stack of payload containers (d) comprising sub-projectiles of different size.
Figure 3B:
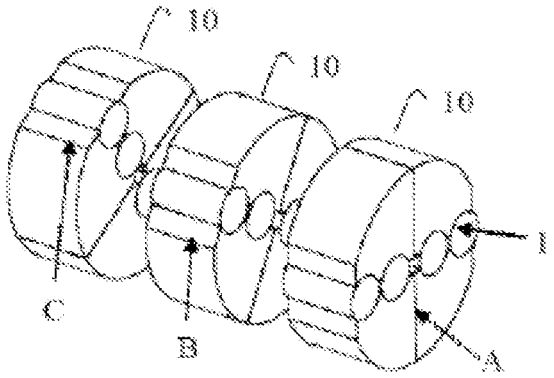

FIGS. 3*a* and *b* show perspective views of three (A, B, C) payload containers 10 arranged after each other in a line, wherein each payload container comprises two (a) or four (b) sub-projectiles 1. The second payload container B is displaced with the angle φ in relation to the first payload container A, and the third payload container C is displaced in relation to the second payload container B and the first payload container A etc.

Figure 3C:
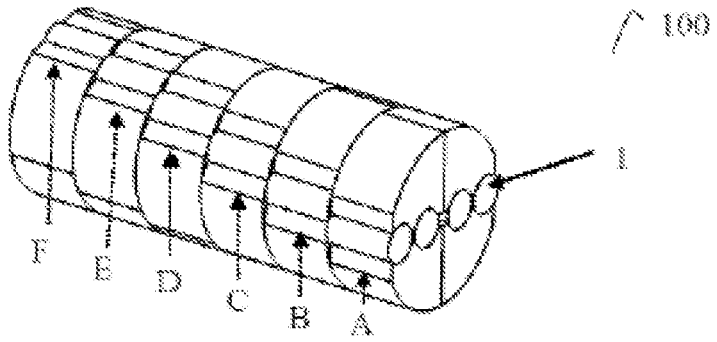
Figure 3D:
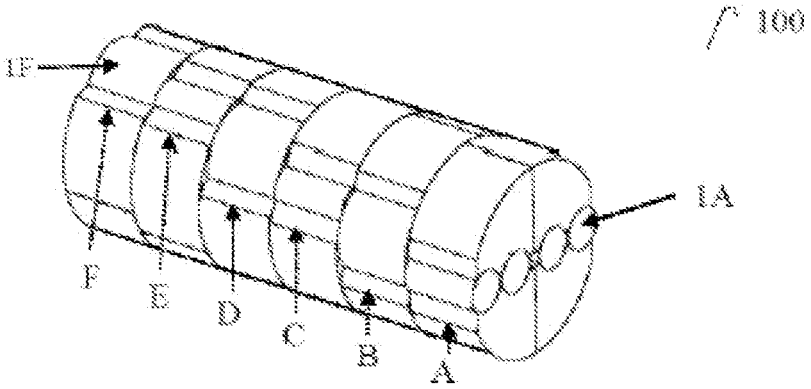

FIG. 3*c* shows a perspective view of six payload containers 10 comprising in this embodiment 4 sub-projectiles 1 each, arranged in a stack 100. Each payload container 10 is angularly displaced in relation to the next container as shown in FIGS. 3(*a*) and (*b*), respectively. The embodiment of the stack 100 shown in d) comprises payload containers 10 comprising four (A, C, E) or two (B, D, F) sub-projectiles 1, respectively. The displacement angle φ of the payload containers 10 compensates for the rotation of the projectile resulting in a horizontal dispersion pattern of the sub-projectiles 1.

The invention is not limited to a particular size or number of sub-projectiles. The sub-projectiles 1 do not need to be of the same size in the same payload container 10. Payload containers 10, arranged after each other i.e., first, second, and third payload container etc. can comprise different types of sub-projectiles 1. A payload container 10 can also comprise more than one layer of sub-projectiles 1, 1'.

Figure 4A:
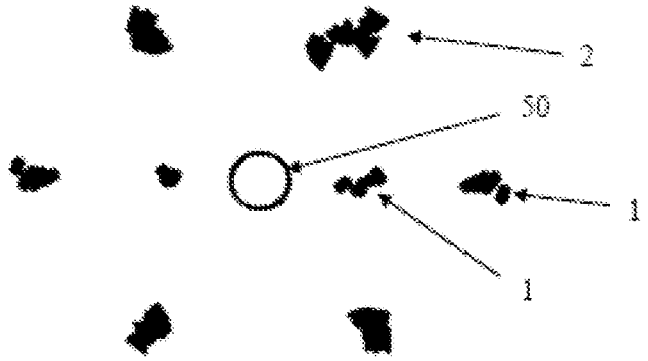
FIGS. 4*a-b*: Show illustrations of the dispersion pattern obtained by using a payload container comprising sub-projectiles of the same size (a), and by using sub-projectiles of different sizes (b).
Figure 4B:
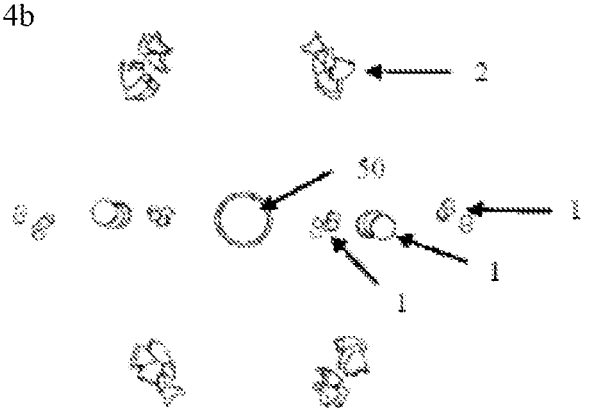

FIGS. 4*a* and *b* show illustrations of the obtained dispersion pattern by using sub-projectiles 1 having the same size (a), or sub-projectiles 1 of different size (b). Projectiles 50 of 57 mm were used and each payload container 10 was displaced in an angle φ of about 15 degrees to the next payload container 10.

Suitable projectiles 50 for exercising the present invention are in the range of 30-155 mm.

The empty projectile 50 is shown in the middle of the illustration and parts of the container wall 2 are shown in the outermost. Released sub-projectiles 1 are lined up horizontally and continue their path to finally hit a predetermined target. The dispersion pattern is horizontal in both cases. The arrangement of the sub-projectiles 1 in the payload container 10 and the degree of displacement angle φ of the payload containers 10 to each other are used to influence the dispersion pattern. The displacement angle φ between the payload containers 10 is arranged in such way that the sub-projectiles 1 have the position as shown in FIGS. 2*b* and 2*d* when the mechanical force from the projectile wall 2 disappears and the sub-projectiles 1 are released. The sub-projectiles 1, 1' are vertically lined at the time when the mechanical force from the carrier shell disappears.

Figure 5A:
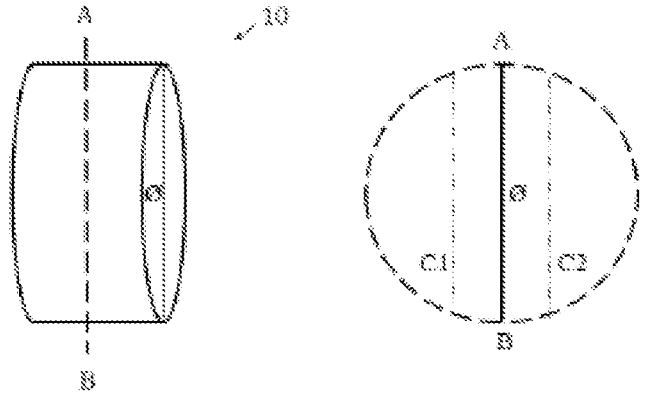
FIGS. 5*a-b* Show a side view of a payload container (a) and a section along line A-B of a payload container as shown in (a) comprising a plurality of spherical sub-projectiles arranged in lines, and in two layers (b).

FIG. 5*a* shows a side view of a payload container 10 (left side). The payload container is in the form of a cylinder. A section of the payload container 10 along line A-B is shown to the right.

Figure 5B:
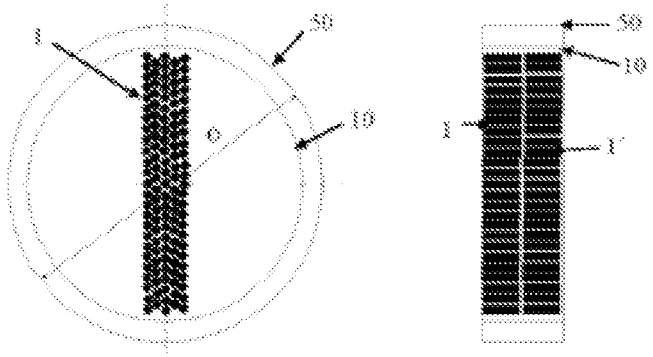

The straight line segments (Ø, C1, C2) inside the circle are chords, wherein the diameter Ø is the longest chord and C1, C2 are shorter. The invention is not limited to 3 lines of sub-projectiles, this example is only for illustrating that the sub-projectiles 1 are disposed along chords in the payload container 10. The sub-projectiles 1, do not have to extent the whole way to the wall 2. A cross section of a projectile 50 in the same direction as above a, left) is shown in FIG. 5*b* (to the left). The projectile 50 comprises a payload container 10 and the sub-projectiles 1 are in this example spherical and arranged in a plurality of lines. The diameter Ø of the projectile 50 is in this case 155 mm. The section on the right shows that the payload container 10 comprises sub-projectiles arranged in two layers; sub-projectiles 1 correspond to a first layer and sub-projectiles 1' correspond to a second layer. The layers are in one plane. In this example there are a total number of 246 sub-projectiles arranged in two layers. 123 spherical sub-projectiles 1 are arranged in the first layer and 123 spherical sub-projectiles are arranged in the second layer. The number of layers may be at least one. The upper limit of the numbers of layers in a payload container 10 is only limited by the aim, the projectile 50 and the payload 1, 1'.

Figure 6A:
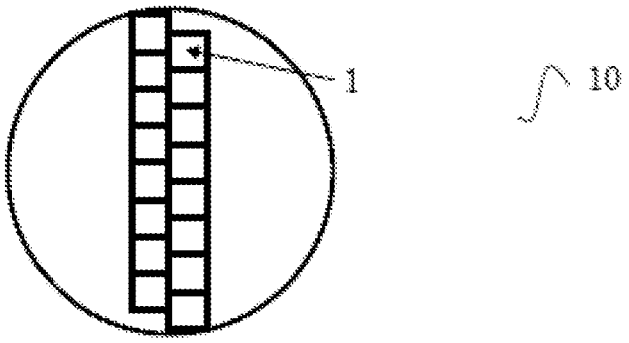
FIGS. 6*a-c* Show a cross-section of a payload container comprising small cuboid sub-projectiles arranged in two lines (a), a stack of payload containers comprising larger cuboid sub-projectiles (b), and an illustration of the obtained dispersion pattern (c).
Figure 6B:
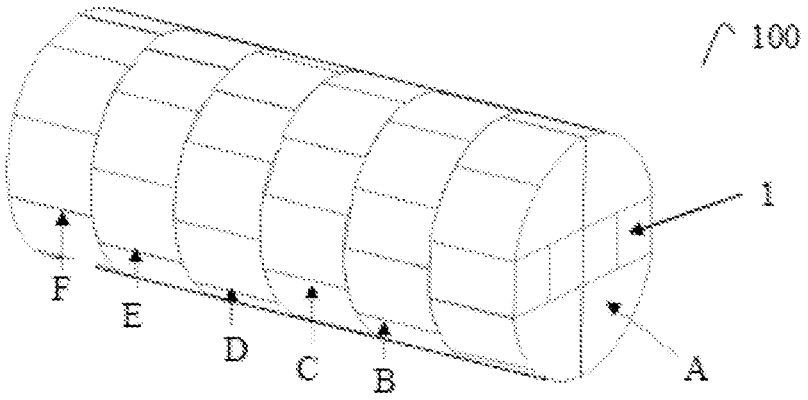
Figure 6C:
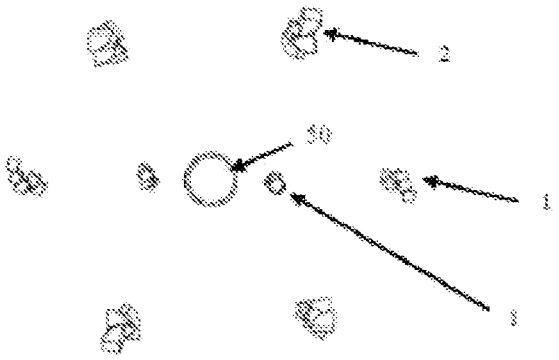

FIG. 6*a-c* show examples of the use of cuboid sub-projectiles 1. The first example shows the use of small cuboid sub-projectiles 1 arranged in two lines (a) in a payload container 10. A stack 100 of six payload containers 10 comprising larger cuboid sub-projectiles 1 arranged in one line is shown in FIG. 6*b*. The payload containers 10 are angularly displaced a predetermined angle φ in relation to each other as described above. The obtained horizontal dispersion pattern by the cuboid sub-projectiles 1 is illustrated in FIG. 6*c*.

An example of using sub-projectiles 1 with hexagonal cross section is shown in FIG. 7. Small sub-projectiles 1 are arranged in a first layer (a), and large sub-projectiles 1' are arranged in a second layer (b) of a payload container 10. The layers are disposed in substantially one plane but with an offset angle between the first and second layer of sub-projectiles 1, 1' (FIG. 7*c*). By small variations of the offset angle between the layers the sub-projectiles 1, can be more spread vertically but still providing a horizontal dispersion pattern.

Figure 8A:
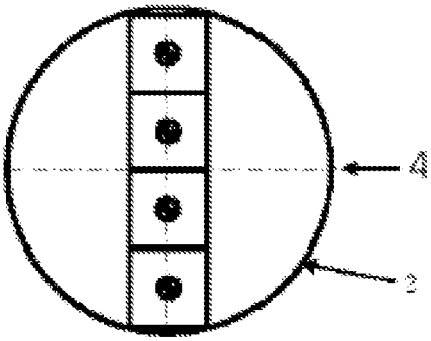
FIGS. 8*a-b* Illustrates a cross section of a payload container comprising sub-projectiles with a rectangular cross section (a), and an embodiment for providing a denser dispersion pattern.
Figure 8B:
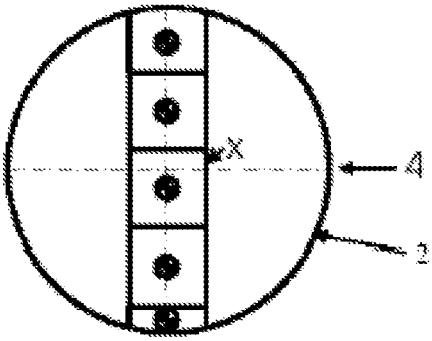

FIG. 8*a* illustrates a payload container 10 comprising sub-projectiles 1 with rectangular cross section arranged in a line, and disposed symmetric on each side of the dividing line 4. FIG. 8*b* shows an embodiment for providing a denser dispersion pattern. Two of the sub-projectiles in the payload container 10 are truncated resulting in sub-projectiles of a different size 1. Each centre of gravity is moved a distance x from the dividing line 4. By varying the distance x in each layer of sub-projectiles 1 a denser spread pattern is obtained. The dispersion velocity for each sub-projectile can be varied by changing the distance to the centre of the payload container (10)

Figure 9:
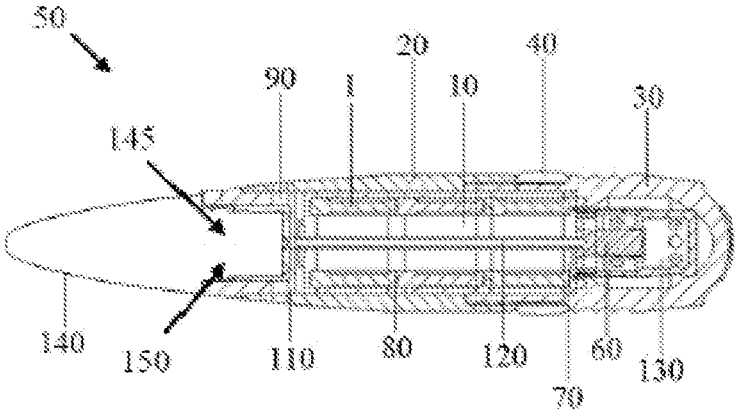
FIG. 9 Shows an example of a projectile suitable for carrying the payload containers of the invention.

FIG. 9 shows a spin stabilized projectile 50, in the form of a carrier shell, suitable for comprising at least one payload container 10 of the present invention. The projectile 50 comprises a front projectile body 20 and a rear projectile body 30 and a rotating band 40. The front and rear projectile body is joined by means of for example a threaded connection, or splines in combination with some form of axial locking. The rear projectile body 30 comprises a separation charge 130 and a pyrotechnic primer device 60 for initiating the separation charge 130. The primer device 60 is arranged in front of the separation charge 130 behind a drive plate 70 adjacent to the rear end of a payload chamber 80 and the front projectile body 20. The separation charge 130 may consist of or comprise a propellant charge of conventional type, for example a propellant charge comprising a smokeless nitrocellulose propellant, or in an alternative embodiment a composite propellant.

The payload chamber 80 arranged in the front projectile body 20 comprises at least one payload container 10 comprising sub-projectiles 1. A time fuze 145, comprising an activation unit for activating the primer device 60 is arranged in the nose part 140 of the front projectile body 20 in front of the payload chamber 80. The nose part 140 is fitted to the front projectile body 20 by a second drive plate 110 and by for example shears pins 90, which are designed to rupture under the effect of the pressure on the separation of the payload chamber 80 from the projectile 50. In an alternative embodiment a continuous detonator wire 120, for example a shock tube, is connected to the pyrotechnic primer device 60 for the propellant charge 130 in the rear part 30, and a primer device in the nose part 140 for initiating the reaction in the shock tube 120 for separating the nose part 140 from the projectile 50.

The separation from the projectile 50 is initiated by a signal from the time fuze 145.

A sensor 150 (for example a gyro, lateral laser/radar) arranged in the nose part 140 keeps track of the rotational position of the projectile 50 relative to ground/water signals and initiates the separation charge 130 in the rear end 30 of the projectile 50. A pressure is built up behind the payload chamber 80 and the payload containers 10 are pressed out from the rotating projectile 50 one by one. The displacement angle φ of each payload container 10 in relation to the next payload container 10 is arranged in such way that the sub-projectiles 1 in the payload container 10 are vertically lined (see FIGS. 2*b, d*) when the mechanical force from the carrier shell disappears and the sub-projectiles 1 are released. The sub-projectiles 1 are spread to the left and to the right, and the empty projectile 50 continues straight forward. Several projectiles 50 are preferably fired in succession.

Other embodiments may have a plurality of sensors for example to provide flight position data by detecting the relative orientation of the projectile body 50 during operation. The output of the sensors is fed into a guidance control system to enable flight corrections when necessary. The guidance control system may be any systems suitable for guiding spin stabilized projectiles during flight.

The payload container 10 is for example manufactured separately; suitable sub-projectiles 1 are arranged in substantially one plain in a payload container 10 in a core 3 material. The at least one payload container 10 comprising sub-projectiles 1 is thereafter arranged in a suitable projectile/carrier shell 50. If a plurality of payload containers 10 (e.g., a stack 100) are arranged in the projectile 50, they are angularly displaced in relation to each other in such way that a horizontal dispersion pattern is obtained when they are ejected against a target.

The sub-projectiles 1 may be made of hard- or heavy metal.

The payload container 10 of the present invention is intended to be used in direct fire, and in commercially available projectiles. Sub-projectiles suitable for the holding device 10 of the present invention are for example rods, flechettes, armor-piercing tungsten carbide projectiles, tungsten spheres, tungsten discs, tungsten cubes, tungsten hexagons etc.

Other features and uses of the invention and their associated advantages will be evident to a person skilled in the art upon reading the description and the examples.

In summary, the present invention provides an inventive device in the form of a payload container and a method for providing a horizontal dispersion pattern optimal for direct fire against surface targets. The invention increase both hit rate, effectiveness and decrease the risk of collateral damage, which are important factors contributing to the economic advantage of the present invention. The sub-projectiles can be made bigger and heavier without increasing the weight of the carrier shell itself, which increase the penetration capability of the sub-projectiles into the target. The present invention also provides a more "inert" carrier shell except the separation charge, which is yet an advantageous from IM point of view.

The invention claimed is:

1. A cylindrical payload container for a spin stabilized projectile, comprising at least two sub-projectiles, a core in which the sub-projectiles are disposed, the sub-projectiles being releasably retained in the core and being linearly disposed along a straight line segment when viewed along a longitudinal axis of the container, and the sub-projectiles being configured to be released from the core due to spinning of the container to form a horizontal dispersion pattern.

2. The payload container according to claim 1, comprising at least two parallel lines of sub-projectiles.

3. The payload container according to claim 1, comprising at least two layers of sub-projectiles arranged in substantially one plane.

4. The payload container according to claim 1, wherein the sub-projectiles are flechettes, rods, spheres, discs, cubes or hexagons.

5. The payload container according to claim 1, wherein the sub-projectiles are made of tungsten or tungsten carbide.

6. The payload container according to claim 1, arranged to at least one more payload container thereby forming a stack of containers, wherein the first payload container is angularly displaced to the second payload container.

7. The payload container arranged to at least one more payload container according to claim 6, wherein each payload container defines an angle of 0-180 degrees to the next payload container.

8. The payload container according to claim 1, wherein the payload container is arranged to at least a second payload container in a payload chamber, thereby forming a stack of containers, wherein the first payload container is angularly displaced to the second payload container by a displacement angle φ (°) that is calculated by the formula:

$$\varphi = \omega_{projectile} \cdot \frac{L_{payload\ container}}{v_{separation}} \cdot \frac{180°}{\pi}$$

wherein

ω is the angular velocity (rad/s) of the projectile;

v is the velocity (m/s) of the payload container in relation to the projectile;

L is the length (m) of the payload chamber; and t is the time (s) it takes for the payload container to leave the projectile.

* * * * *